US011718933B2

(12) United States Patent
Tian

(10) Patent No.: US 11,718,933 B2
(45) Date of Patent: Aug. 8, 2023

(54) PENTA-AXIAL BRAIDING MACHINE

(71) Applicant: The Boeing Company, Chicago, IL (US)

(72) Inventor: Jacquelynn Xueting Tian, Melbourne (AU)

(73) Assignee: The Boeing Company, Chicago, IL (US)

( * ) Notice: Subject to any disclaimer, the term of this patent is extended or adjusted under 35 U.S.C. 154(b) by 84 days.

(21) Appl. No.: 17/445,370

(22) Filed: Aug. 18, 2021

(65) Prior Publication Data

US 2023/0057825 A1 Feb. 23, 2023

(51) Int. Cl.

| | |
|---|---|
| ***D04C 3/40*** | (2006.01) |
| ***D04C 3/48*** | (2006.01) |
| ***D04C 3/22*** | (2006.01) |

(52) U.S. Cl.

CPC ..... *D04C 3/40* (2013.01); *D04C 3/22* (2013.01); *D04C 3/48* (2013.01)

(58) Field of Classification Search

CPC ... D04C 3/22; D04C 3/34; D04C 3/36; D04C 3/40; D04C 3/44; D04C 3/48

See application file for complete search history.

(56) References Cited

U.S. PATENT DOCUMENTS 1,188,741 A * 6/1916 Dunkerley ..... D04C 3/12 87/30
1,725,450 A * 8/1929 Frederickson ..... D04C 3/00 87/44
1,864,249 A * 6/1932 Horn ..... D04C 3/16 87/45
1,921,174 A * 8/1933 Tober ..... D04C 3/16 87/48
4,304,169 A * 12/1981 Cimprich ..... D04C 3/36 181/290
4,372,191 A * 2/1983 Iannucci ..... D04C 3/48 87/48
4,519,290 A * 5/1985 Inman ..... F02K 9/97 87/9

(Continued)

OTHER PUBLICATIONS

Ebel et al.; "Interaction of braiding ring geometry and fiber lay-up in the braiding process"; A Comprehensive Approach to Carbon Composites Technology; Symposium on the occation of the 5th Anniversary of the Institute for Carbon Composites; Research Campus Garching; Sep. 11-12, 2014; 20 pages.

(Continued)

*Primary Examiner* — Shaun R Hurley
(74) *Attorney, Agent, or Firm* — Yee & Associates, P.C.

(57) ABSTRACT

A penta-axial braiding assembly comprising: a braiding machine comprising: a circular machine bed with an interior curved surface, an exterior curved surface, and a front face; radial bobbins associated with the interior curved surface and configured to dispense a first number of yarns; and front face bobbins associated with the front face and configured to dispense a second number of yarns. A first guide assembly comprising a first braiding plate configured to form a first braiding point for the first number of yarns from the radial bobbins. A second guide assembly comprising a second braiding plate configured to form a second braiding point for the second number of yarns dispensed from the front face bobbins.

28 Claims, 11 Drawing Sheets

(56) References Cited

U.S. PATENT DOCUMENTS 4,936,186 A * 6/1990 Sekido ..... D04C 1/06 87/8
5,048,441 A * 9/1991 Quigley ..... B29C 53/8008 428/113
5,146,835 A * 9/1992 McConnell ..... D04C 3/48 87/7
5,188,872 A * 2/1993 Quigley ..... D04C 3/48 428/36.1
5,320,696 A * 6/1994 McConnell ..... B29C 53/845 87/9
5,979,288 A * 11/1999 Gallagher ..... D04C 3/48 87/41
6,024,005 A * 2/2000 Uozumi ..... D04C 3/34 87/29
6,655,253 B2 * 12/2003 Uchida ..... D04C 1/06 87/9
6,679,152 B1 1/2004 Head et al.
7,252,028 B2 * 8/2007 Bechtold ..... D04C 3/48 87/34
7,444,916 B2 * 11/2008 Hirukawa ..... D04C 3/36 87/34
8,006,601 B2 * 8/2011 Inazawa ..... B32B 5/12 87/7
8,757,038 B2 6/2014 Siegismund
10,260,183 B2 4/2019 Marchand et al.
10,526,732 B2 * 1/2020 Rapp ..... D04C 3/48
2006/0207415 A1 * 9/2006 Bechtold ..... D04C 3/48 87/33
2007/0186760 A1 * 8/2007 Masao ..... D04C 3/48 87/14
2010/0052203 A1 * 3/2010 Inazawa ..... D04C 3/08 264/103
2010/0083815 A1 * 4/2010 Inazawa ..... B29C 70/32 87/9
2016/0355956 A1 12/2016 Baumgart et al.
2018/0023229 A1 * 1/2018 Rapp ..... D04C 3/48 87/9
2021/0276282 A1 * 9/2021 Alarcon Lorente .... B29C 70/32

OTHER PUBLICATIONS

Van Ravenhorst; "Design Tools for Circular Overbraiding of Complex Mandrels"; PhD Thesis, University of Twente, Enschede, The Netherlands; Sep. 2018; 278 pages.

* cited by examiner

PENTA-AXIAL BRAIDING MACHINE

BACKGROUND INFORMATION

1. Field

The present disclosure relates generally to braiding multifilament yarns or tows, and more specifically to a braiding machine capable of producing a penta-axial braided product.

2. Background

Composite materials are strong, light-weight materials created by combining two or more constituent materials. For example, a composite material may include fiber reinforcements set in a polymer resin matrix. The fiber reinforcements may be in the form of unidirectional fibers or may take the form of a woven fabric. The fiber reinforcements and resins are cured to form a composite material.

One method of manufacturing the fiber reinforcement is braiding. In braiding, continuous multifilament yarns or tows are applied to a mandrel by moving the yarns relative to each other to form an interlocking pattern. Braiding machines have been developed that apply biaxial or triaxial braids onto a mandrel.

To apply additional material to the biaxial or triaxial braid, additional braiding or deposition machines can be positioned downstream of the braiding machine. However, each additional manufacturing machine takes up manufacturing floor space and increases a manufacturing footprint for creating the braided product.

Therefore, it would be desirable to have a method and apparatus that takes into account at least some of the issues discussed above, as well as other possible issues. For example, it would be desirable to provide a manufacturing machine that could reduce a footprint for braiding products.

SUMMARY

An embodiment of the present disclosure provides a penta-axial braiding assembly comprising: a braiding machine comprising: a circular machine bed with an interior curved surface, an exterior curved surface, and a front face; radial bobbins associated with the interior curved surface and configured to dispense a first number of yarns; and front face bobbins associated with the front face and configured to dispense a second number of yarns. A first guide assembly comprising a first braiding plate configured to form a first braiding point for the first number of yarns from the radial bobbins. A second guide assembly comprising a second braiding plate configured to form a second braiding point for the second number of yarns dispensed from the front face bobbins.

Another embodiment of the present disclosure provides a braiding machine comprising: a circular machine bed with an interior curved surface, an exterior curved surface, and a front face; radial bobbins associated with the interior curved surface and configured to dispense a first number of yarns; and front face bobbins associated with the front face and configured to dispense a second number of yarns.

Yet another embodiment of the present disclosure provides a guide assembly comprising: a frame; a braiding plate removably connected to the frame, the braiding plate having an aperture; and a movement system connected to the frame and configured to move the frame across a manufacturing floor.

A further embodiment of the present disclosure provides a method. A base is sent through a braiding machine, a first guide assembly, and a second guide assembly, the braiding machine comprising a circular machine bed with an interior curved surface, an exterior curved surface, and a front face, radial bobbins associated with the interior curved surface and configured to dispense a first number of yarns, and front face bobbins associated with the front face and configured to dispense a second number of yarns. The first number of yarns is braided onto the base at a first braiding point created by the first braiding plate of the first guide assembly. The second number of yarns is braided over the first number of yarns at a second braiding point created by the second braiding plate of the second guide assembly.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative examples recognize and take into account one or more different considerations. The illustrative examples recognize and take into account that conventional braiding machines can include stationary axial bobbins and two sets of bobbins that move in opposing serpentine fashion. The two sets of bobbins are loaded into carriers. The carriers are attached to horndog gears to provide for the opposing serpentine movement. The axial bobbins and two sets of bobbins dispense yarns to create a triaxial braid.

The illustrative examples recognize and take into account that in circular braiding machines having two sets of bobbins associated with a front, flat machine bed, a slack absorption mechanism draws loose yarn into the bobbin and then releases the yarn. The repeated recoil and release of yarns can lead to yarn damage.

The illustrative examples recognize and take into account that conventional braiding machines are limited to only up to three sets of yarns. To apply different yarns, additional braiding machines will be set up later in the production line. Additional braiding machines take up additional manufacturing space.

The illustrative examples provide a braiding assembly configured to apply up to five types of yarn to a base using a single machine bed. The illustrative examples provide a braiding assembly configured to apply a penta-axial braid using a single machine. The illustrative examples are configured to provide guide assemblies that are more easily adjusted. The illustrative examples are configured to provide guide assemblies that can be moved farther from the machine bed without an undesirable amount of time or effort. The illustrative examples are configured to provide guide assemblies with even vibration to create a higher quality braided product.

Figure 1:
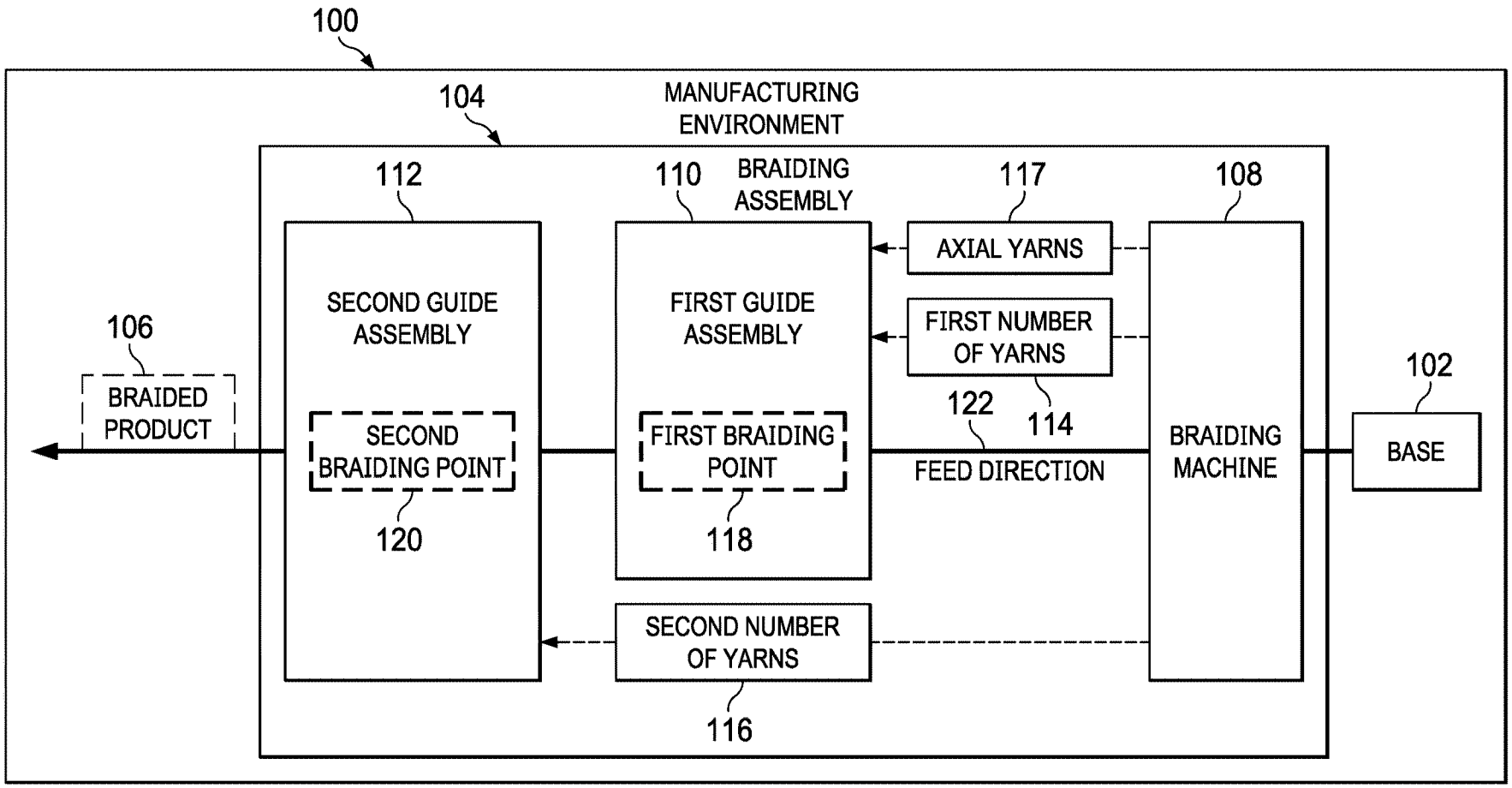
FIG. 1 is a block diagram of a manufacturing environment in which an illustrative embodiment may be implemented.

Turning now to FIG. 1, a block diagram of a manufacturing environment in which an illustrative embodiment may be implemented is depicted. In manufacturing environment 100, base 102 is sent through braiding assembly 104 to form braided product 106 on base 102.

Base 102 takes any desirable form. In some illustrative examples, base 102 is a mandrel or other desirable forming tool. In some illustrative examples, base 102 is a product to receive braided yarns. In some illustrative examples, base 102 is a number of yarns.

Braiding assembly 104 is a penta-axial braiding assembly. Braiding assembly 104 is configured to form braided product 106 that is penta-axial. Braided product 106 formed by braiding assembly 104 can have five different types of yarns.

Braiding assembly 104 comprises braiding machine 108, first guide assembly 110, and second guide assembly 112. Braiding machine 108 is configured to provide first number of yarns 114 and second number of yarns 116 to form braided product 106. As used herein, "a number of" when used with reference to items means one or more items. For example, first number of yarns 114 includes one or more yarns. In some illustrative examples, first number of yarns 114 includes two sets of yarns to form a biaxial braid. In some illustrative examples, axial yarns 117 are also dispensed from braiding machine 108. When present, axial yarns 117 and first number of yarns 114 include three sets of yarns to form a triaxial braid. Second number of yarns 116 includes one or more yarns. In one illustrative example, second number of yarns 116 includes two sets of yarns to form a biaxial braid.

First guide assembly 110 is configured to form first braiding point 118 for material dispensed from braiding machine 108. First guide assembly 110 is configured to form first braiding point 118 for first number of yarns 114. Second guide assembly 112 is configured to form second braiding point 120 for material dispensed from braiding machine 108. Second guide assembly 112 is configured to form second braiding point 120 for second number of yarns 116.

First braiding point 118 is closer to braiding machine 108 than second braiding point 120. As base 102 moves in feed direction 122, base 102 encounters first guide assembly 110 first. First number of yarns 114 is braided onto base 102 prior to second number of yarns 116 being braided.

Braided product 106 comprises second number of yarns 116 over first number of yarns 114. Braiding machine 108 is configured to produce braided product 106 with first number of yarns 114 having a first angle and second number of yarns 116 having a second angle. In some illustrative examples, the first angle is different from the second angle. In some illustrative examples, the first angle is the same as the second angle.

To produce braided product 106, base 102 is sent through braiding machine 108, first guide assembly 110, and second guide assembly 112. Braiding machine 108 comprises a circular machine bed with an interior curved surface, an exterior curved surface, and a front face, radial bobbins associated with the interior curved surface and configured to dispense first number of yarns 114, and front face bobbins associated with the front face and configured to dispense second number of yarns 116.

First number of yarns 114 is braided onto base 102 at first braiding point 118 created by a first braiding plate of first guide assembly 110. Second number of yarns 116 is braided over first number of yarns 114 at second braiding point 120 created by a second braiding plate of second guide assembly 112.

Figure 2:
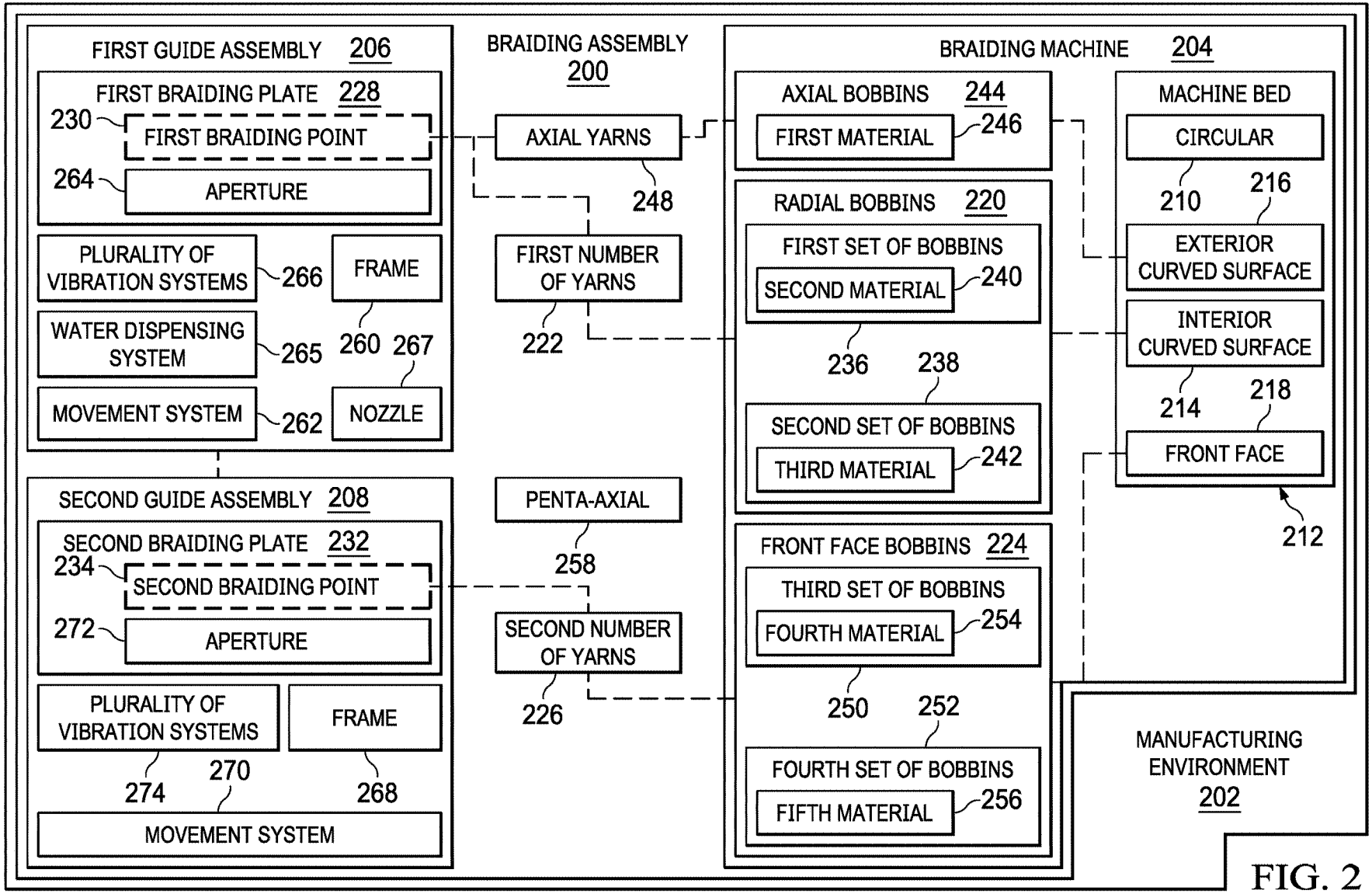
FIG. 2 is a block diagram of a manufacturing environment in which an illustrative embodiment may be implemented.

Turning now to FIG. 2, a block diagram of a manufacturing environment in which an illustrative embodiment may be implemented is depicted. Braiding assembly 200 is present in manufacturing environment 202. Braiding assembly 200 is an example of braiding assembly 104 of FIG. 1.

Braiding assembly 200 comprises braiding machine 204, first guide assembly 206, and second guide assembly 208. Braiding machine 204 comprises circular 210 machine bed 212 with interior curved surface 214, exterior curved surface 216, and front face 218; radial bobbins 220 associated with interior curved surface 214 and configured to dispense first number of yarns 222; and front face bobbins 224 associated with front face 218 and configured to dispense second number of yarns 226.

First guide assembly 206 comprises first braiding plate 228 configured to form first braiding point 230 for first number of yarns 222 dispensed from radial bobbins 220. Second guide assembly 208 comprises second braiding plate 232 configured to form second braiding point 234 for second number of yarns 226 dispensed from front face bobbins 224.

In some illustrative examples, first number of yarns 222 and second number of yarns 226 are selected based on processing and manufacturing considerations. In some illustrative examples, fourth material 254 and fifth material 256 of second number of yarns 226 dispensed from front face bobbins 224 are less prone to breakage than first number of yarns 222.

Braiding machine 204 is an implementation of braiding machine 108 of FIG. 1. First guide assembly 206 is an implementation of first guide assembly 110 of FIG. 1. Second guide assembly 208 is an implementation of second guide assembly 112 of FIG. 1.

Radial bobbins 220 comprises first set of bobbins 236 and second set of bobbins 238. First set of bobbins 236 and second set of bobbins 238 are configured to move in opposing serpentine motion to each other. First set of bobbins 236 and second set of bobbins 238 are positioned in a patterned order based on a desired braid style of the braided product. In some illustrative examples, first set of bobbins 236 and second set of bobbins 238 are positioned in an alternating order. Radial bobbins 220 are associated with interior curved surface 214 by being indirectly and movably connected to interior curved surface 214. Although not depicted in FIG. 2, radial bobbins 220 travel along tracks and are connected to gears to facilitate the opposing serpentine motion.

First set of bobbins 236 dispenses second material 240. Second set of bobbins 238 dispenses third material 242. In some illustrative examples, second material 240 is the same as third material 242. In some illustrative examples, second material 240 is different from third material 242. First number of yarns 222 includes second material 240 and third material 242. First material 246 can be the same or different than either of second material 240 or third material 242.

Braiding machine 204 further comprises axial bobbins 244. Axial bobbins 244 dispense first material 246. Axial yarns 248 includes first material 246.

Front face bobbins 224 comprises third set of bobbins 250 and fourth set of bobbins 252. Third set of bobbins 250 and fourth set of bobbins 252 are configured to move in opposing serpentine motion to each other. Third set of bobbins 250 and fourth set of bobbins 252 are positioned in alternating order. Front face bobbins 224 are associated with front face 218 by being indirectly and movably connected to front face 218. Although not depicted in FIG. 2, front face bobbins 224 travel along tracks and are connected to gears to facilitate the opposing serpentine motion.

Third set of bobbins 250 dispenses fourth material 254. Fourth set of bobbins 252 dispenses fifth material 256. In some illustrative examples, fourth material 254 is the same as fifth material 256. In some illustrative examples, fourth material 254 is different from fifth material 256. Second number of yarns 226 includes fourth material 254 and fifth material 256. First material 246 can be the same or different than either of fourth material 254 or fifth material 256. Fourth material 254 can be the same or different from any of second material 240 or third material 242. Fifth material 256 can be the same or different from any of second material 240 or third material 242.

Braiding machine 204 is configured to produce a braided product with first number of yarns 222 having a first angle and second number of yarns 226 having a second angle. In some illustrative examples, the first angle is different from the second angle. In some illustrative examples, the first angle is the same as the second angle. When present, axial yarns 248 are parallel to the longitudinal axis of the braided product.

The first angle of first number of yarns 222 is affected by a cross-sectional shape of a base, a feed speed of the base, and rotational speed of radial bobbins 220. The second angle of second number of yarns 226 is affected by a cross-sectional shape of a base, a feed speed of the base, and rotational speed of front face bobbins 224. In some illustrative examples, rotational speed of radial bobbins 220 and rotational speed of front face bobbins 224 are different. In some illustrative examples, rotational speed of radial bobbins 220 and rotational speed of front face bobbins 224 are the same. In some illustrative examples, radial bobbins 220 are configured to dispense first number of yarns 222 substantially perpendicular to a dispensed direction of second number of yarns 226.

Braiding assembly 200 can be referred to as penta-axial 258 braiding assembly 200. Braiding assembly 200 is referred to as penta-axial 258 as braiding machine 204 is configured to form a braided product from five materials: first material 246, second material 240, third material 242, fourth material 254, and fifth material 256.

First guide assembly 206 further comprises frame 260 and movement system 262. First braiding plate 228 is removably connected to frame 260. Movement system 262 is connected to frame 260 and configured to move frame 260 towards or away from braiding machine 204. Movement system 262 takes any desirable form. In some illustrative examples, movement system 262 comprises a plurality of wheels. In some illustrative examples, movement system 262 is a portion of rail system.

By being removably connected to frame 260, first braiding plate 228 can be removed and replaced with a different braiding plate. First braiding plate 228 has aperture 264. First braiding plate 228 with aperture 264 is selected based on a cross-sectional shape of a braided product. To generate a braided product with a different shape, first braiding plate 228 can be replaced within first guide assembly 206 with an aperture having at least one of a different size or a different shape than aperture 264.

First braiding plate 228 can be manufactured using any desirable technique. In some illustrative examples, first braiding plate 228 can be cast, milled, machined, or three-dimensionally printed. First braiding plate 228 can be any desirable material. In some illustrative examples, first braiding plate 228 is formed from a polymer or a metal.

First guide assembly 206 further comprises plurality of vibration systems 266 mounted to first braiding plate 228. Plurality of vibration systems 266 is configured to provide even controlled vibration on first braiding plate 228. Plurality of vibration systems 266 provides controlled vibration. Plurality of vibration systems 266 is programmable. Plurality of vibration systems 266 can be programmed based on type of material for first material 246, second material 240, and third material 242. By programming the vibration provided by plurality of vibration systems 266, a higher quality product is produced.

In some illustrative examples, plurality of vibration systems 266 is programmed based on prior braided products created using the same materials as first number of yarns 222 and axial yarns 248. In some illustrative examples, plurality of vibration systems 266 is adjusted in-line based on inspection of the braided product comprising first number of yarns 222, second number of yarns 226, and axial yarns 248.

Plurality of vibration systems 266 includes any desirable quantity of vibrations systems. Plurality of vibration systems 266 is positioned radially around aperture 264. In some illustrative examples, plurality of vibration systems 266 is positioned evenly around aperture 264 of first braiding plate 228.

In some illustrative examples, at least one of first guide assembly 206 or second guide assembly 208 comprises a water dispensing system. In some illustrative examples, at least one of first guide assembly 206 or second guide assembly 208 comprises a respective water dispensing system mounted to a first face of the respective braiding plate and configured to dispense water onto a plurality of yarns prior to extending through the respective aperture. In some illustrative examples, first guide assembly 206 comprises water dispensing system 265. In some illustrative examples, first guide assembly 206 comprises water dispensing system 265 mounted to a first face of first braiding plate 228 and configured to dispense water onto a plurality of yarns prior to extending through aperture 264.

In some illustrative examples, at least one of first guide assembly 206 or second guide assembly 208 comprises a nozzle mounted to the respective braiding plate. In some illustrative examples, at least one of first guide assembly 206 or second guide assembly 208 comprises a nozzle mounted to the respective braiding plate, the nozzle configured to dispense air. In some illustrative examples, first guide assembly 206 has nozzle 267 mounted to first braiding plate 228. In some illustrative examples, nozzle 267 is configured to dispense air.

Second guide assembly 208 further comprises frame 268 and movement system 270. Second braiding plate 232 is removably connected to frame 268. Movement system 270 is connected to frame 268 and configured to move frame 268 towards or away from braiding machine 204. Movement system 270 takes any desirable form. In some illustrative examples, movement system 270 comprises a plurality of wheels. In some illustrative examples, movement system 270 is a portion of rail system.

By being removably connected to frame 268, second braiding plate 232 can be removed and replaced with a different braiding plate. Second braiding plate 232 has aperture 272. Second braiding plate 232 with aperture 272 is selected based on a cross-sectional shape of a braided product. To generate a braided product with a different shape, second braiding plate 232 can be replaced within second guide assembly 208 with an aperture having at least one of a different size or a different shape than aperture 272.

Second braiding plate 232 can be manufactured using any desirable technique. In some illustrative examples, second braiding plate 232 can be cast, milled, machined, or three-dimensionally printed. Second braiding plate 232 can be any desirable material. In some illustrative examples, second braiding plate 232 is formed from a polymer or a metal.

Second guide assembly 208 further comprises plurality of vibration systems 274 mounted to second braiding plate 232. Plurality of vibration systems 274 is configured to provide even controlled vibration on second braiding plate 232. The frequency and amplitude of the vibration can be controlled. Plurality of vibration systems 274 provides controlled vibration. Plurality of vibration systems 274 is programmable. Plurality of vibration systems 274 can be programmed based on type of material for fourth material 254 and fifth material 256. By programming the vibration provided by plurality of vibration systems 274, a higher quality product is produced.

In some illustrative examples, plurality of vibration systems 274 is programmed based on prior braided products created using the same materials as second number of yarns 226. In some illustrative examples, plurality of vibration systems 266 is adjusted in-line based on inspection of the braided product comprising first number of yarns 222, second number of yarns 226, and axial yarns 248.

Plurality of vibration systems 274 includes any desirable quantity of vibrations systems. Plurality of vibration systems 274 is positioned radially around aperture 272. In some illustrative examples, plurality of vibration systems 274 is positioned evenly around aperture 272 of second braiding plate 232.

Figure 3:
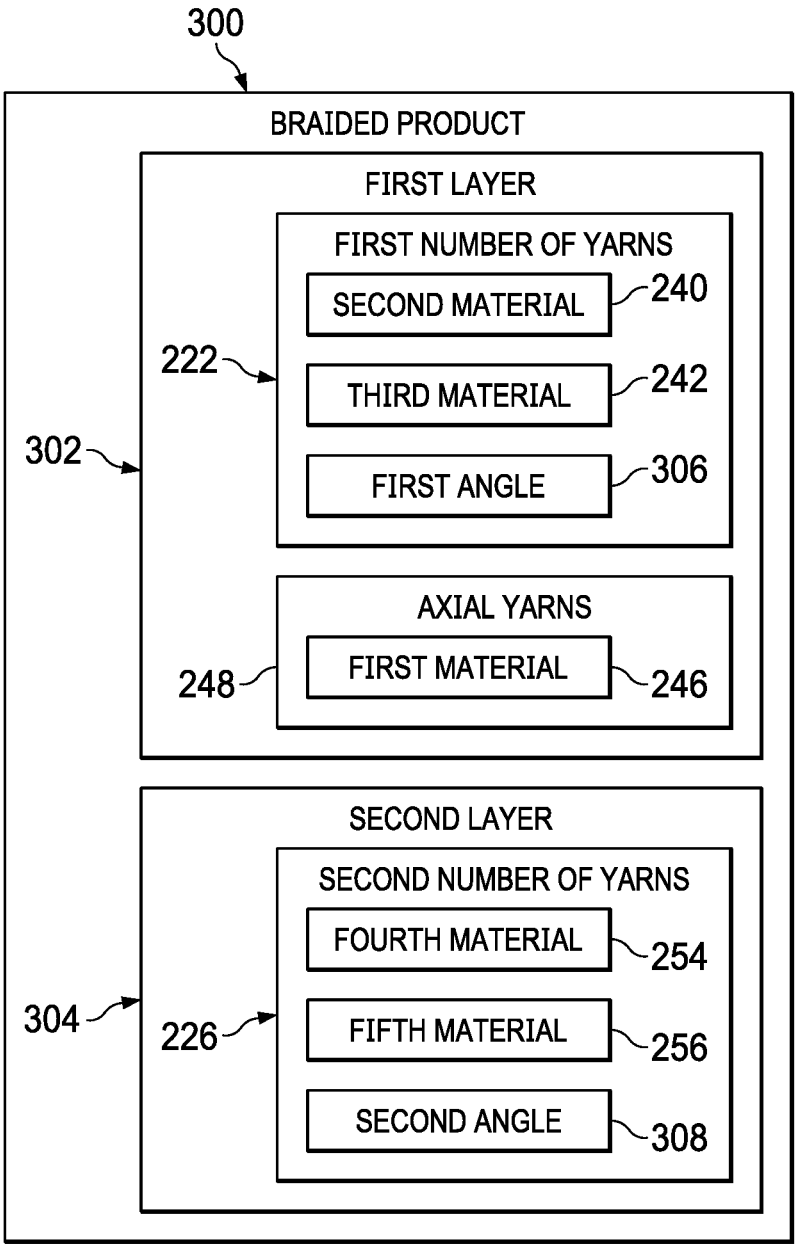
FIG. 3 is a block diagram of a braided product in accordance with an illustrative embodiment.

Turning now to FIG. 3, a block diagram of a braided product is depicted in accordance with an illustrative embodiment. Braided product 300 is an example of braided product 106 of FIG. 1. Braided product 300 can be formed by braiding assembly 200 of FIG. 2. Braided product 300 comprises first layer 302 and second layer 304. In braided product 300, second layer 304 is braided over first layer 302. First layer 302 comprises first number of yarns 222 and axial yarns 248. Second layer 304 comprises second number of yarns 226.

First number of yarns 222 in braided product have first angle 306. Second number of yarns 226 have second angle 308. In some illustrative examples, first angle 306 is different from second angle 308. In some illustrative examples, first angle 306 is the same as second angle 308.

The illustration of braiding assembly 104 in FIG. 1, braiding assembly 200 in FIG. 2, and braided product 300 in FIG. 3 are not meant to imply physical or architectural limitations to the manner in which an illustrative embodiment may be implemented. Other components in addition to or in place of the ones illustrated may be used. Some components may be unnecessary. Also, the blocks are presented to illustrate some functional components. One or more of these blocks may be combined, divided, or combined and divided into different blocks when implemented in an illustrative embodiment. For example, first material 246 of axial yarns 248 can be optional. Further, although braiding machine 108 and braiding machine 204 are configured to produce penta-axial braided products, in some illustrative examples, braiding machine 108 and braiding machine 204 can generate braided materials with fewer than five kinds of yarns. For example, either braiding machine 108 or braiding machine 204 can be used to generate a bi-axial braided product with only first number of yarns 114 or first number of yarns 222. As another example, either braiding machine 108 or braiding machine 204 can be used to generate a bi-axial braided product with only second number of yarns 116 or second number of yarns 226. As another example, either braiding machine 108 or braiding machine 204 can be used to generate a tri-axial braided product with only axial yarns 117 or axial yarns 248 and first number of yarns 114 or first number of yarns 222. As yet another example, either braiding machine 108 or braiding machine 204 can be used to generate a quadra-axial braided product with only first number of yarns 114 or first number of yarns 222 and second number of yarns 116 or second number of yarns 226.

Figure 4:
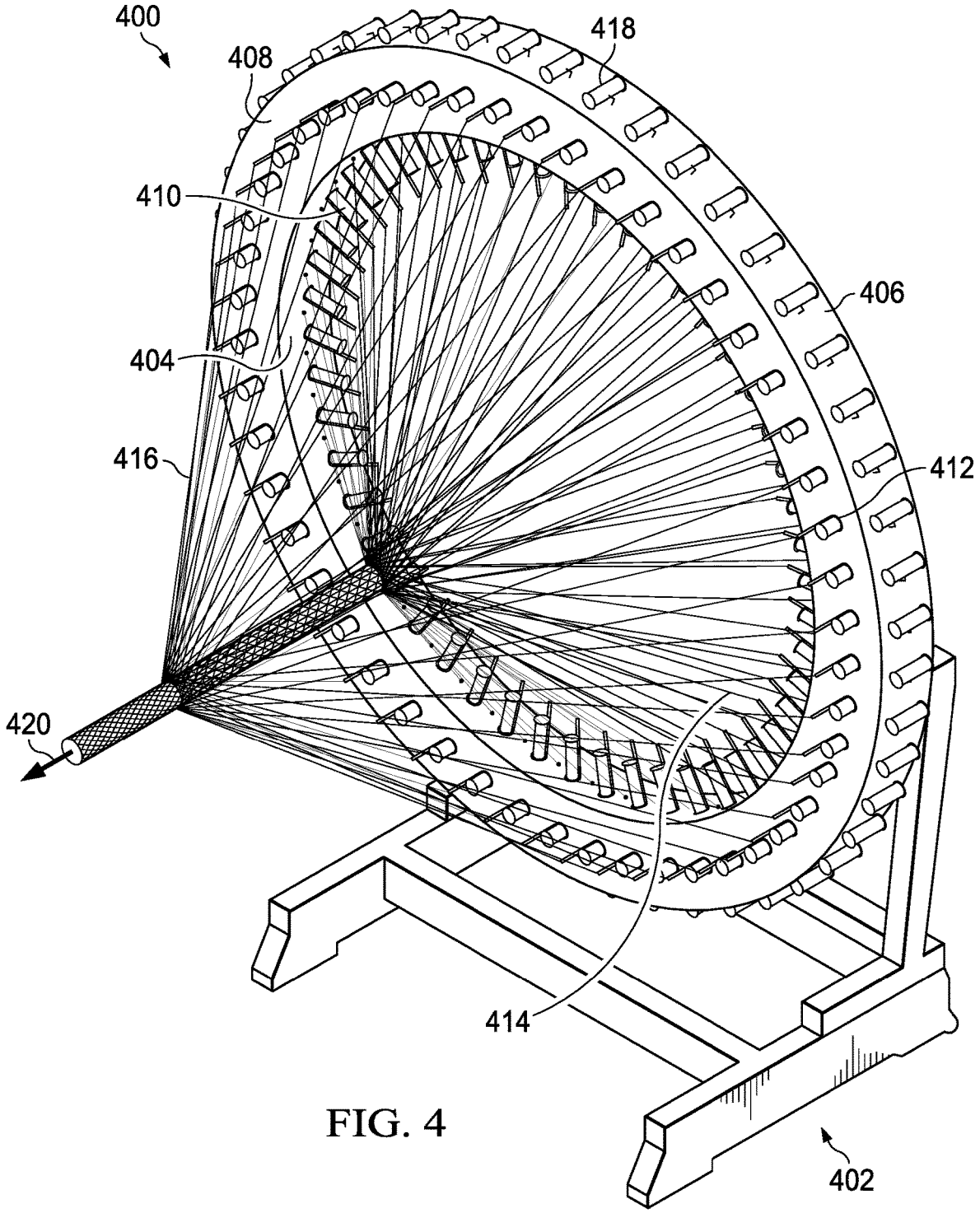
FIG. 4 is an isometric view of a braiding machine in accordance with an illustrative embodiment.

Turning now to FIG. 4, an isometric view of a braiding machine is depicted in accordance with an illustrative embodiment. Braiding machine 400 is a physical implementation of braiding machine 108 of FIG. 1. Braiding machine 400 is a physical implementation of braiding machine 204 of FIG. 2. Braiding machine 400 can be used to dispense yarns to form braided product 300 of FIG. 3.

Braiding machine 400 comprises circular machine bed 402 with interior curved surface 404, exterior curved surface 406, and front face 408; radial bobbins 410; and front face bobbins 412. Radial bobbins 410 are associated with interior curved surface 404 and configured to dispense first number of yarns 414. Front face bobbins 412 are associated with front face 408 and configured to dispense second number of yarns 416. In some illustrative examples, radial bobbins 410 are configured to dispense first number of yarns 414 substantially perpendicular to a dispensed direction of second number of yarns 416.

As depicted, braiding machine 400 further comprises axial bobbins 418 configured to dispense axial yarns. Axial bobbins 418 are associated with exterior curved surface 406. Axial bobbins 418 are stationary. Radial bobbins 410 comprise a first set of bobbins and a second set of bobbins configured to move in opposing serpentine motion to each other. The first set of bobbins and second set of bobbins are positioned in a patterned order. Although not visible in FIG. 4, radial bobbins 410 travel along tracks and are connected to gears to facilitate the opposing serpentine motion.

Front face bobbins 412 comprises a third set of bobbins and a fourth set of bobbins configured to move in opposing serpentine motion to each other. The third set of bobbins and fourth set of bobbins are positioned in a patterned order. Although not visible in FIG. 4, front face bobbins 412 travel along tracks and are connected to gears to facilitate the opposing serpentine motion.

As can be seen in FIG. 4, first number of yarns 414 exits radial bobbins 410 substantially perpendicular to interior curved surface 404. As can be seen in FIG. 4, first number of yarns 414 exits radial bobbins 410 substantially perpendicular to feed direction 420 of braiding machine 400.

As can be seen in FIG. 4, second number of yarns 416 exits front face bobbins 412 substantially perpendicular to front face 408. As can be seen in FIG. 4, second number of yarns 416 exits front face bobbins 412 substantially parallel to feed direction 420 of braiding machine 400.

Figure 5:
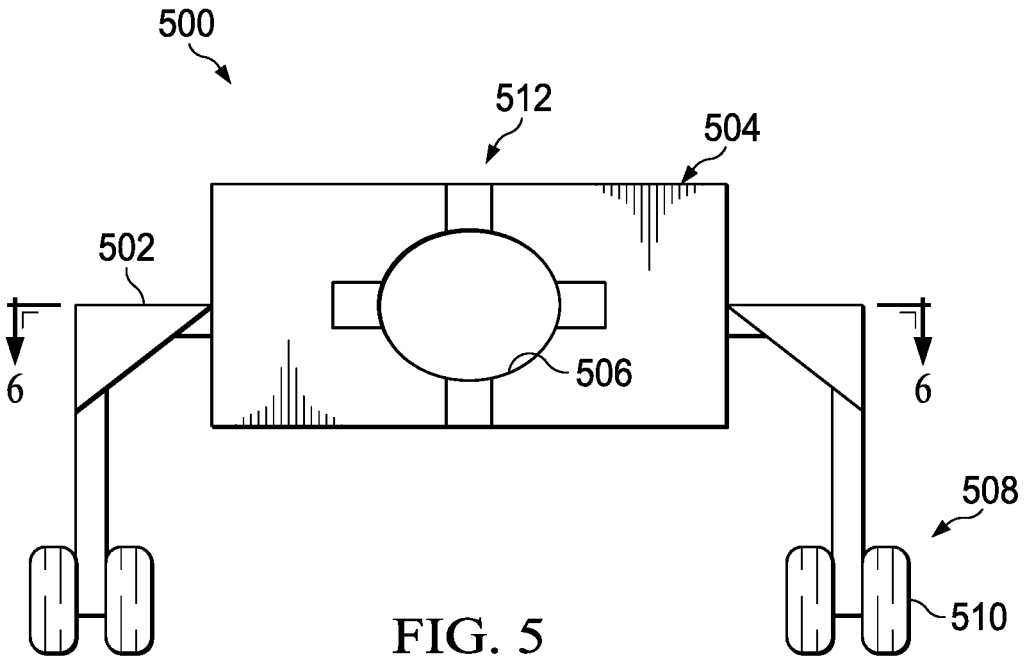
FIG. 5 is a front view of a guide assembly in accordance with an illustrative embodiment.

Turning now to FIG. 5, a front view of a guide assembly is depicted in accordance with an illustrative embodiment. Guide assembly 500 is a physical implementation of either first guide assembly 110 or second guide assembly 112 of FIG. 1. Guide assembly 500 is a physical implementation of either first guide assembly 206 or second guide assembly 208 of FIG. 2. Guide assembly 500 can be used to form braided product 300 of FIG. 3. Guide assembly 500 can be used along with braiding machine 400 of FIG. 4 to form a braided product.

Guide assembly 500 comprises frame 502, braiding plate 504 removably connected to frame 502 and having aperture 506, and movement system 508 connected to frame 502 and configured to move frame 502 across a manufacturing floor. In this illustrative example, movement system 508 comprises wheels 510. By moving frame 502 using movement system 508, guide assembly 500 is moved relative to a braiding machine. Movement system 508 moves guide assembly 500 more easily than exchanging an arm to reposition a conventional braid ring in a conventional braiding assembly.

Shape of aperture 506 is configured based on a cross-sectional shape of a braided product to be produced. Braiding plate 504 is removable so that braiding plate 504 can be replaced to produce a braided product of a different desired cross-section.

As depicted, plurality of vibration systems 512 is mounted to braiding plate 504. Plurality of vibration systems 512 is configured to evenly vibrate braiding plate 504 to reduce friction with yarns passing through aperture 506. As depicted, plurality of vibration systems 512 is positioned evenly around aperture 506 of braiding plate 504.

Figure 6:
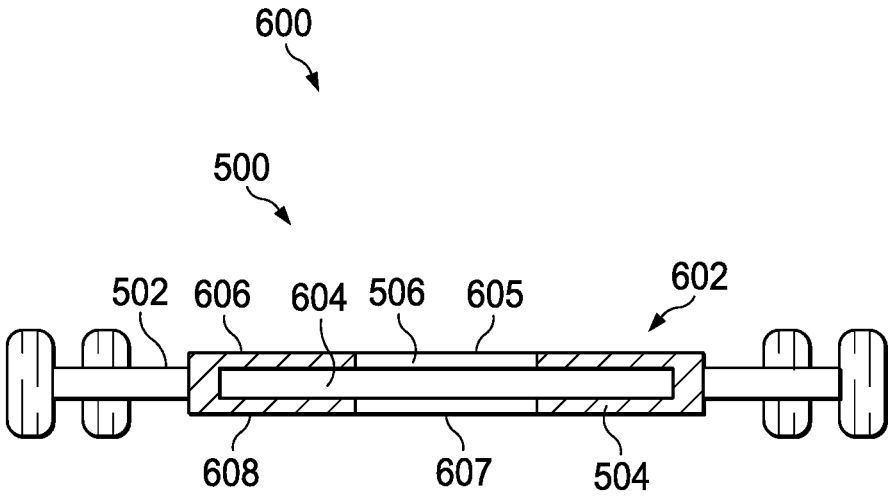
FIG. 6 is a top cross-sectional view of a guide assembly in accordance with an illustrative embodiment.

Turning now to FIG. 6, a top cross-sectional view of a guide assembly is depicted in accordance with an illustrative embodiment. View 600 is a top view of guide assembly 500 of FIG. 5. In this illustrative example, braiding plate 504 is hollow 602. When braiding plate 504 is hollow 602, processing can be performed on yarns within braiding plate 504 as the yarns are moving through aperture 506. In this illustrative example, aperture 506 is formed by opening 605 in first face 606 and opening 607 in second face 608. Although the shape and size of opening 605 in first face 606 and opening 607 in second face 608 are depicted as the same in FIG. 6, in some non-depicted examples, the shape and size of opening 605 and opening 607 can be different from each other. In some illustrative examples, opening 605 in first face 606 is larger than opening 607 in second face 608.

In some illustrative examples, a nozzle is mounted so that processing is performed on yarns within space 604. In some illustrative examples, a nozzle mounted to the braiding plate, the nozzle configured to dispense air. In some illustrative examples, a nozzle is mounted so that a liquid is applied to the yarns as they pass through space 604. A nozzle can be mounted to at least one of first face 606 or second face 608 to direct at least one of heating, cooling, a liquid, or a gas towards yarns extending through aperture 506.

In some illustrative examples, a water dispensing system (not depicted) is mounted to first face 606 of braiding plate 504 and configured to dispense water onto a plurality of yarns prior to extending through the aperture. In some illustrative examples, a water dispensing system is mounted to second face 608 of braiding plate 504.

The illustration of guide assembly 500 in FIGS. 5 and 6 is not meant to imply physical or architectural limitations to the manner in which an illustrative embodiment may be implemented. Other components in addition to or in place of the ones illustrated may be used. Some components may be unnecessary.

For example, aperture 506 can take any desirable form based on a cross-sectional shape of a desired braided product. As another example, braiding plate 504 can be solid rather than hollow 602. In these illustrative examples, space 604 is not present and aperture 506 is formed by a single opening.

Figure 7:
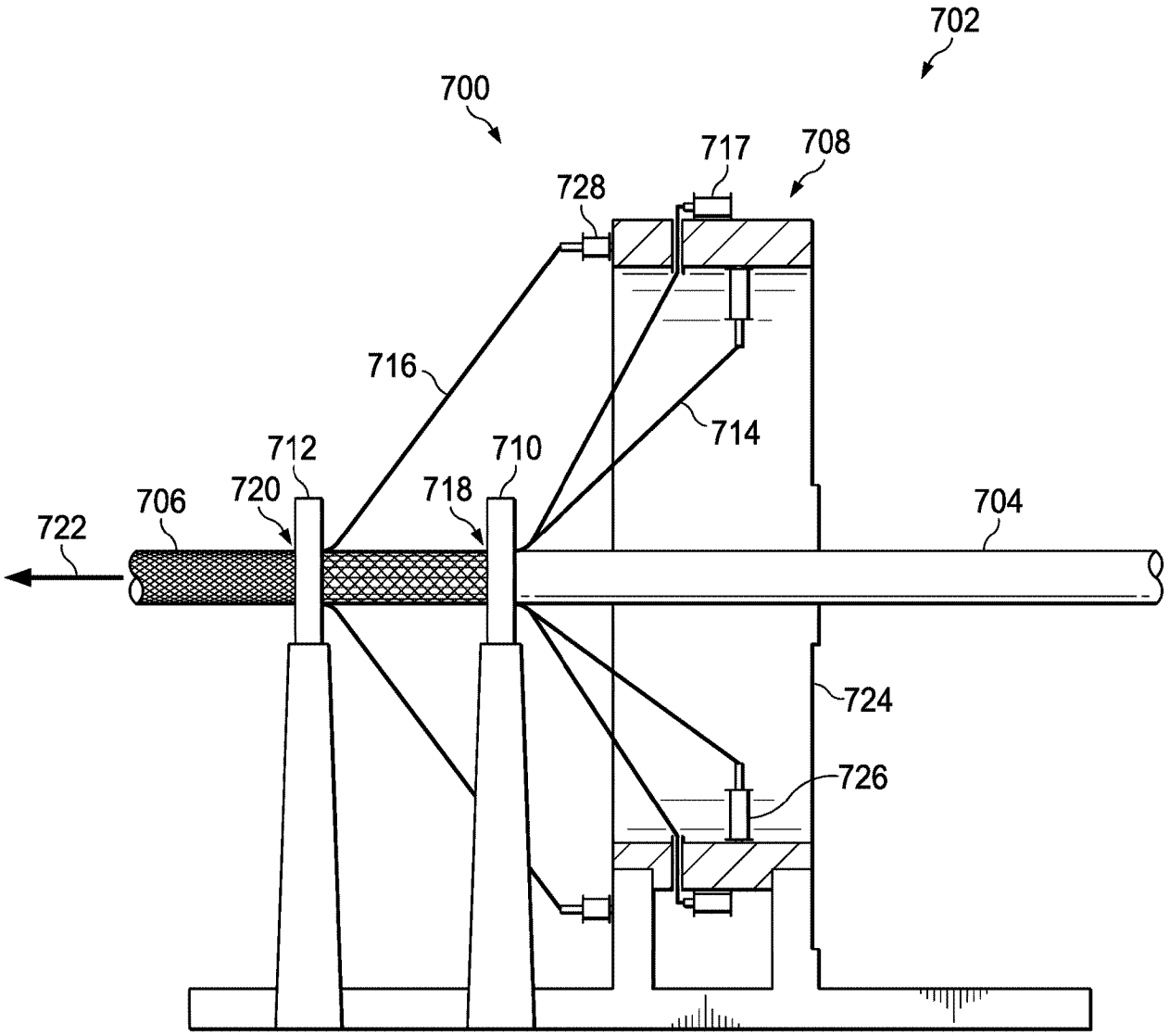
FIG. 7 is a side view of a braiding assembly with a cross-sectional view through a braiding machine in accordance with an illustrative embodiment.

Turning now to FIG. 7, a side view of a braiding assembly with a cross-sectional view through a braiding machine is depicted in accordance with an illustrative embodiment. Braiding assembly 700 is a physical implementation of braiding assembly 104 of FIG. 1. Braiding assembly 700 is a physical implementation of braiding assembly 200 of FIG. 2. Braiding assembly 700 can be used to form braided product 300 of FIG. 3. Braiding assembly 700 can include braiding machine 400 of FIG. 4. Braiding assembly 700 can include guide assembly 500 of FIGS. 5-6.

In manufacturing environment 702, base 704 is sent through braiding assembly 700 to form braided product 706 on base 704.

Braiding assembly 700 is a penta-axial braiding assembly. Braiding assembly 700 is configured to form braided product 706 that is penta-axial. Braided product 706 formed by braiding assembly 700 can have five different types of yarns.

Braiding assembly 700 comprises braiding machine 708, first guide assembly 710, and second guide assembly 712. Braiding machine 708 is configured to provide first number of yarns 714 and second number of yarns 716 to form braided product 706. As used herein, "a number of" when used with reference to items means one or more items. For example, first number of yarns 714 includes one or more yarns. In some illustrative examples, first number of yarns 714 includes two sets of yarns to form a biaxial braid. In some illustrative examples, axial yarns are also dispensed from braiding machine 708. In these illustrative examples, axial yarns are dispensed from axial bobbins 717. When present, axial yarns and first number of yarns 714 include three sets of yarns to form a triaxial braid. Second number of yarns 716 includes one or more yarns. In one illustrative example, second number of yarns 716 includes two sets of yarns to form a biaxial braid. Second number of yarns 716 includes one or more yarns. In one illustrative example, second number of yarns 716 includes two sets of yarns to form a biaxial braid.

First guide assembly 710 is configured to form first braiding point 718 for material dispensed from braiding machine 708. First guide assembly 710 is configured to form first braiding point 718 for first number of yarns 714. Second guide assembly 712 is configured to form second braiding point 720 for material dispensed from braiding machine 708. Second guide assembly 712 is configured to form second braiding point 720 for second number of yarns 716.

First braiding point 718 is closer to braiding machine 708 than second braiding point 720. As base 704 moves in feed direction 722, base 704 encounters first guide assembly 710 first. First number of yarns 714 is braided onto base 704 prior to second number of yarns 716 being braided.

Braided product 706 comprises second number of yarns 716 over first number of yarns 714. Braiding machine 708 is configured to produce braided product 706 with first number of yarns 714 having a first angle and second number of yarns 716 having a second angle. In some illustrative examples, the first angle is different from the second angle. In some illustrative examples, the first angle is the same as the second angle.

To produce braided product 706, base 704 is sent through braiding machine 708, first guide assembly 710, and second guide assembly 712. Braiding machine 708 comprises a circular machine bed with an interior curved surface, an exterior curved surface, and a front face, radial bobbins associated with the interior curved surface and configured to dispense first number of yarns 714, and front face bobbins associated with the front face and configured to dispense second number of yarns 716.

First number of yarns 714 is braided onto base 704 at first braiding point 718 created by a first braiding plate of first guide assembly 710. Second number of yarns 716 is braided over first number of yarns 714 at second braiding point 720 created by a second braiding plate of second guide assembly 712.

Braiding machine 708 comprises circular machine bed 724, radial bobbins 726, and front face bobbins 728. Circular machine bed 724 has an interior curved surface, an exterior curved surface, and a front face. Radial bobbins 726 are associated with the interior curved surface and configured to dispense first number of yarns 714. Front face bobbins 728 are associated with the front face and are configured to dispense second number of yarns 716.

Figure 8:
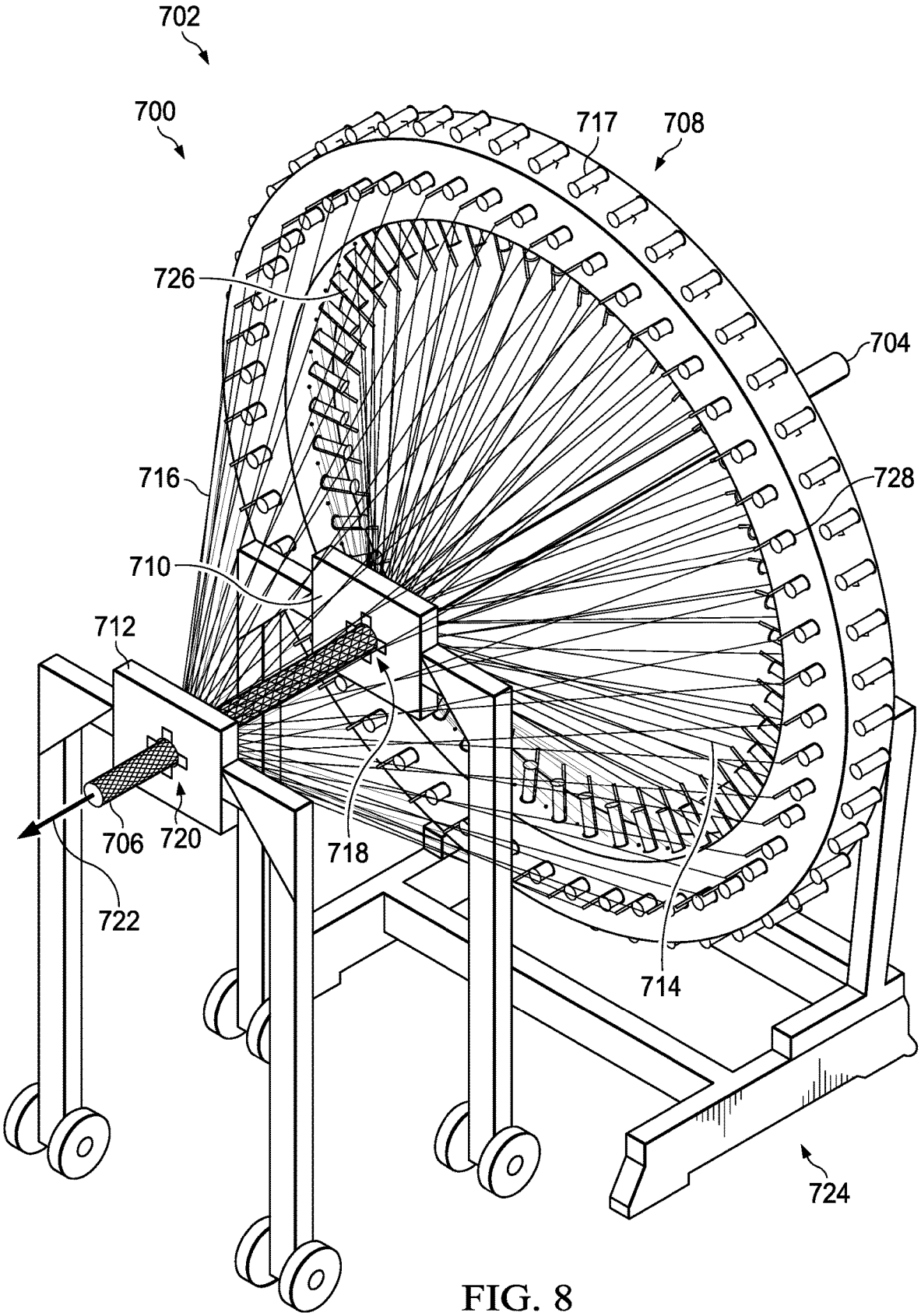
FIG. 8 is an isometric view of a braiding assembly in accordance with an illustrative embodiment.

Turning now to FIG. 8, an isometric view of a braiding assembly is depicted in accordance with an illustrative embodiment. View is an isometric view of braiding assembly 700 of FIG. 7. First braiding point 718 and second braiding point 720 are more easily visible in FIG. 8.

Figure 9:
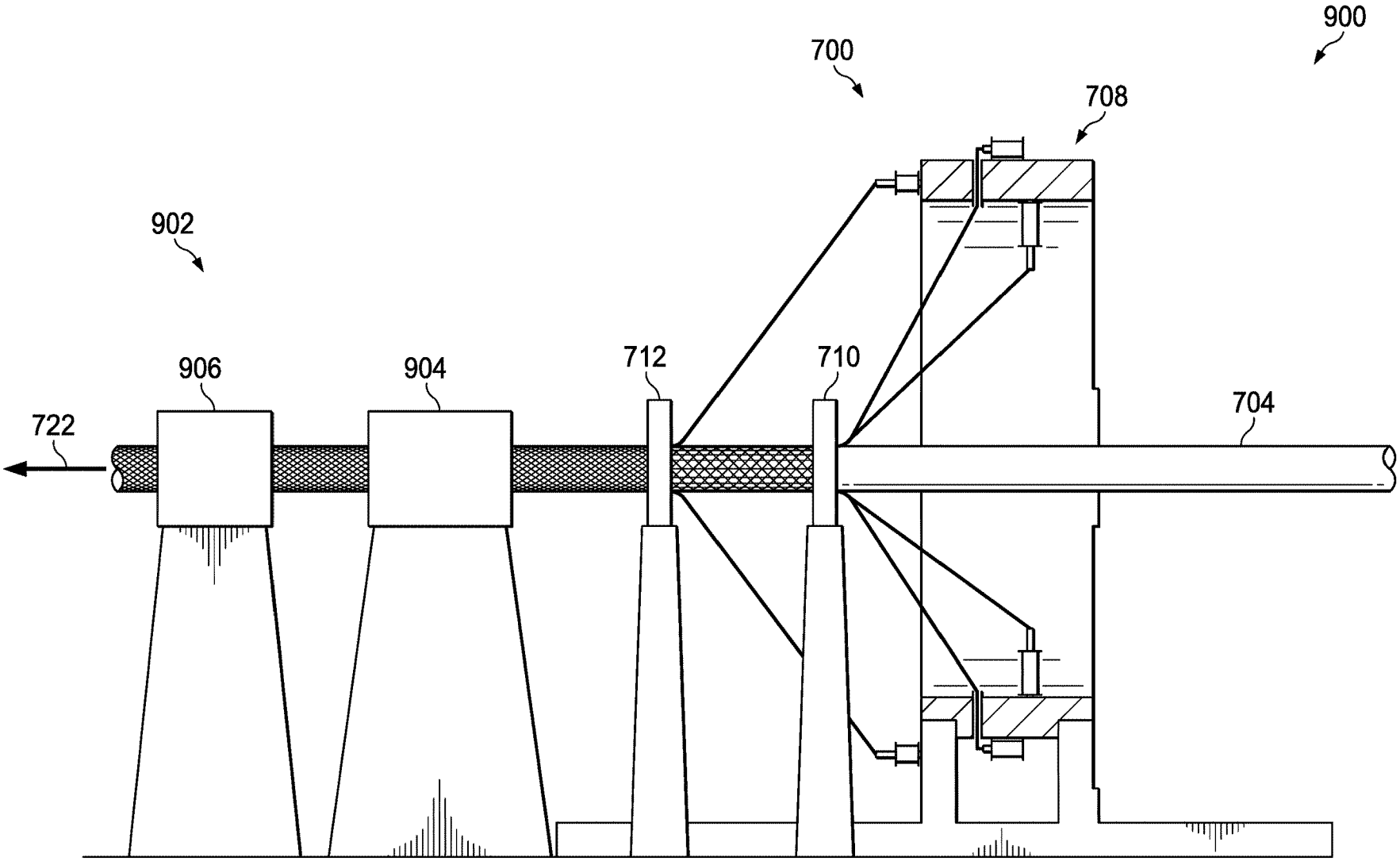
FIG. 9 is a side isometric view of a braiding assembly with a cross-sectional view through a braiding machine with post-braiding processing in accordance with an illustrative embodiment.

Turning now to FIG. 9, a side view of a braiding assembly with a cross-sectional view through a braiding machine with post-braiding processing is depicted in accordance with an illustrative embodiment. View 900 is a view of braiding assembly 700 including braiding machine 708, first guide assembly 710, second guide assembly 712, and processing systems 902. Processing systems 902 can perform any desirable after-braiding processing methods. In some illustrative examples, processing systems 902 includes at least one of imaging, heating, cooling, cleaning, or any other desirable processes.

In some illustrative examples, processing systems 902 comprise imaging system 904 and heating system 906. Imaging system 904 can be used for in-line process monitoring and control adjustments. For example, outputs of imaging system 904 can be used to adjust rotational speed of at least one of front face bobbins 728 or radial bobbins 726. As another example, outputs of imaging system 904 can be used to adjust feed speed of base 704 in feed direction 722.

In other illustrative examples, output of imaging system 904 can be used for inspection and acceptance of parts after manufacturing. In some illustrative examples, output of imaging system 904 can be used for process control.

Figure 10:
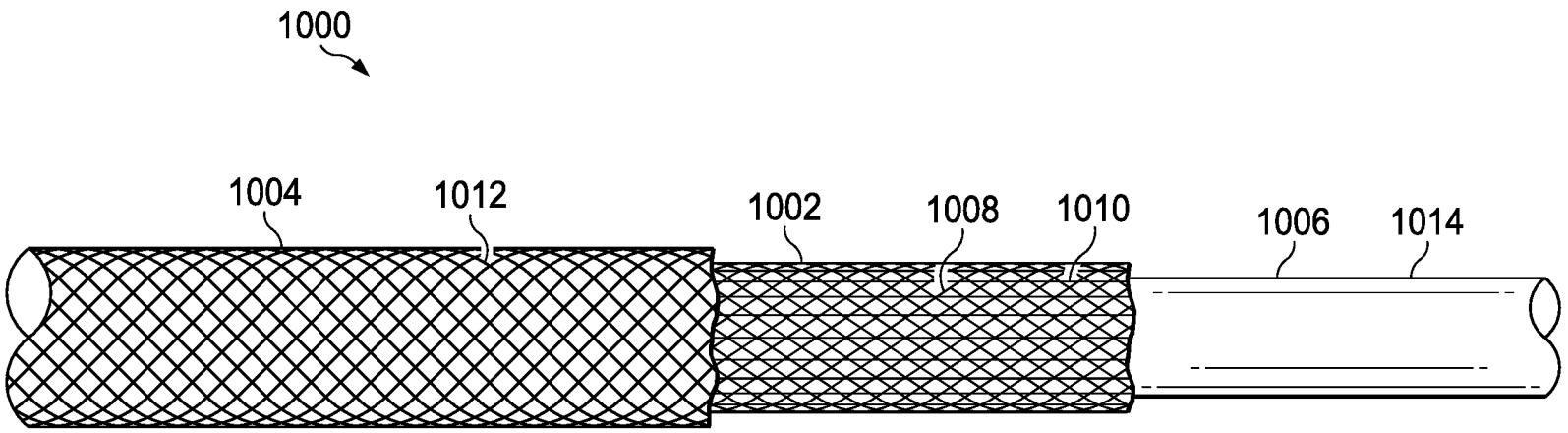
FIG. 10 is a cutaway view of a braided product in accordance with an illustrative embodiment.

Turning now to FIG. 10, a cutaway view of a braided product is depicted in accordance with an illustrative embodiment. Braided product 1000 is a physical implementation of braided product 106 of FIG. 1. Braided product 1000 is a physical implementation of a braided product that can be produced by braiding assembly 200 of FIG. 2. Braided product 1000 is a physical implementation of braided product 300 of FIG. 3. Braided product 1000 can be created using braiding machine 400 of FIG. 4. Braided product 1000 can be created using guide assembly 500 of FIGS. 5-6. Braided product 1000 can be created using braiding assembly 700 of FIGS. 7-9.

Braided product 1000 comprises first layer 1002 and second layer 1004. In braided product 1000, second layer 1004 is braided over first layer 1002 on base 1006. As depicted, first layer 1002 comprises first number of yarns 1008 and axial yarns 1010. First number of yarns 1008 in braided product 1000 has a first angle. Second layer 1004 comprises second number of yarns 1012. Second number of yarns 1012 has a second angle.

In some illustrative examples, the first angle is different from the second angle. In some illustrative examples, the first angle is the same as the second angle.

Braided product 1000 is formed over base 1006. In this illustrative example, base 1006 takes the form of mandrel 1014. In other illustrative examples, base 1006 can be a product or a number of yarns.

Figure 11:
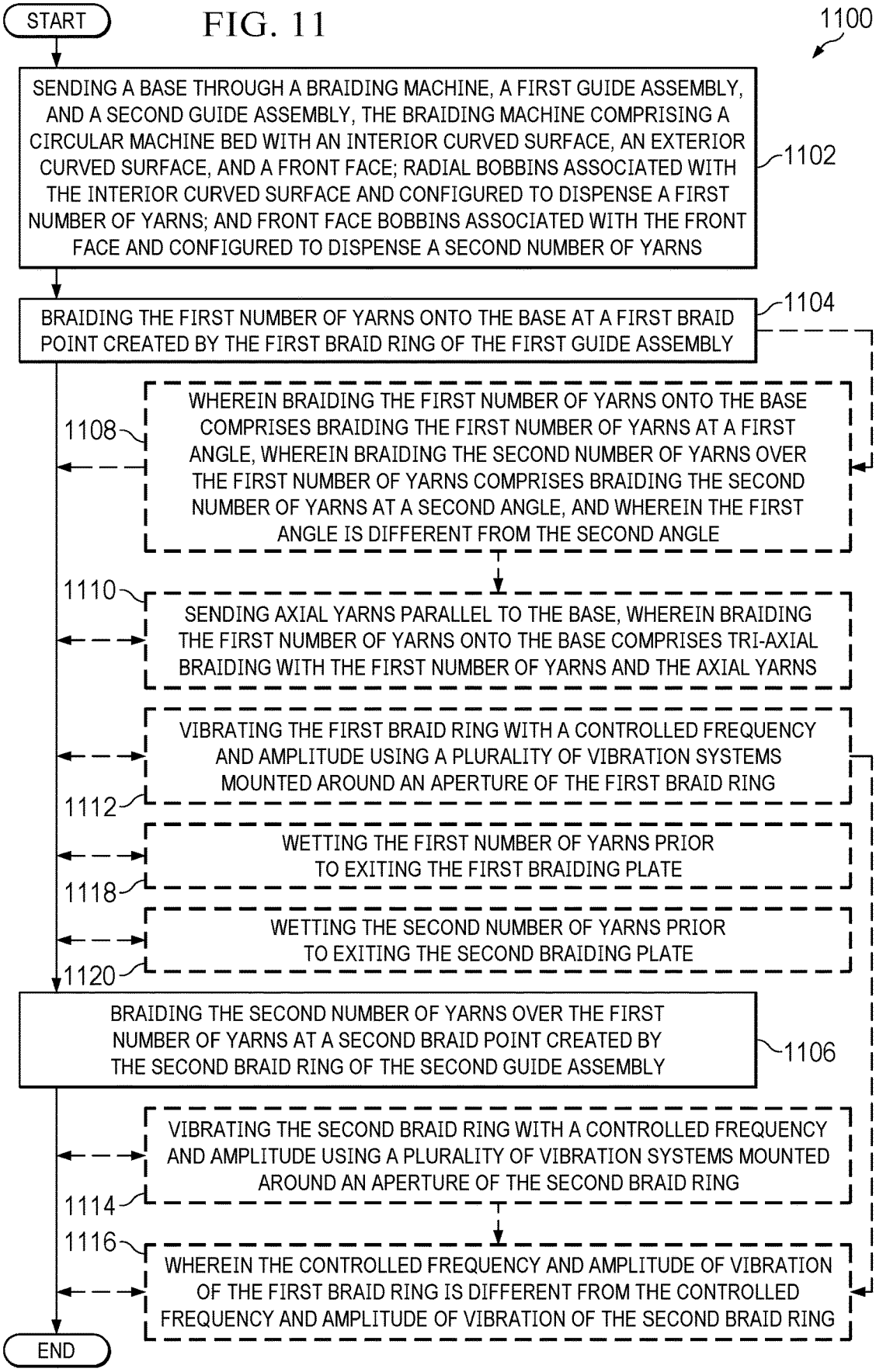
FIG. 11 is a flowchart of a method of forming a braided product in accordance with an illustrative example.

Turning now to FIG. 11, a flowchart of a method of forming a braided product is depicted in accordance with an illustrative example. Method 1100 can be performed using base 102 and braiding assembly 104 of FIG. 1. Method 1100 can be performed using braiding assembly 200 of FIG. 2. Method 1100 can be performed to form braided product 300 of FIG. 3. Method 1100 can be performed using braiding machine 400 of FIG. 4. Method 1100 can be performed using guide assembly 500 of FIGS. 5 and 6. Method 1100 can be performed using braiding assembly 700 of FIGS. 7-9. Method 1100 can be performed to form braided product 1000 of FIG. 10.

Method 1100 sends a base through a braiding machine, a first guide assembly, and a second guide assembly, the braiding machine comprising a circular machine bed with an interior curved surface, an exterior curved surface, and a front face, radial bobbins associated with the interior curved surface and configured to dispense a first number of yarns, and front face bobbins associated with the front face and configured to dispense a second number of yarns (operation 1102). In these illustrative examples, the front face is perpendicular to the interior curved surface. The radial bobbins face inward from the interior curved surface Method 1100 braids the first number of yarns onto the base at a first braiding point created by a first braiding plate of the first guide assembly (operation 1104). The base takes any desirable form. In some illustrative examples, the base can be a product, a number of yarns, or a mandrel. Method 1100 braids the second number of yarns over the first number of yarns at a second braiding point created by a second braiding plate of the second guide assembly (operation 1106). Afterwards, method 1100 terminates.

In some illustrative examples, method 1100 further comprises braiding the first number of yarns onto the base comprises braiding the first number of yarns at a first angle, wherein braiding the second number of yarns over the first number of yarns comprises braiding the second number of yarns at a second angle, and wherein the first angle is different from the second angle (operation 1108). In some illustrative examples, method 1100 further comprises sending axial yarns parallel to the base, wherein braiding the first number of yarns onto the base comprises tri-axial braiding with the first number of yarns and the axial yarns (operation 1110).

In some illustrative examples, method 1100 further comprises vibrating the first braiding plate with a controlled frequency and amplitude using a plurality of vibration systems mounted around an aperture of the first braiding plate (operation 1112). In some illustrative examples, method 1100 further comprises vibrating the second braiding plate with a controlled frequency and amplitude using a plurality of vibration systems mounted around an aperture of the second braiding plate (operation 1114). In some illustrative examples, the controlled frequency and amplitude of vibration of the first braiding plate is different from the controlled frequency and amplitude of vibration of the second braiding plate (operation 1116).

In some illustrative examples, method 1100 further comprises wetting the first number of yarns prior to exiting the first braiding plate (operation 1118). In some illustrative examples, method 1100 further comprises wetting the second number of yarns prior to exiting the second braiding plate (operation 1120).

As used herein, the phrase "at least one of," when used with a list of items, means different combinations of one or more of the listed items may be used and only one of each item in the list may be needed. For example, "at least one of item A, item B, or item C" may include, without limitation, item A, item A and item B, or item B. This example also may include item A, item B, and item C or item B and item C. Of course, any combinations of these items may be present. In other examples, "at least one of" may be, for example, without limitation, two of item A; one of item B; and ten of item C; four of item B and seven of item C; or other suitable combinations. The item may be a particular object, thing, or a category. In other words, at least one of means any combination items and number of items may be used from the list but not all of the items in the list are required.

The flowcharts and block diagrams in the different depicted examples illustrate the architecture, functionality, and operation of some possible implementations of apparatuses and methods in an illustrative example. In this regard, each block in the flowcharts or block diagrams may represent at least one of a module, a segment, a function, or a portion of an operation or step.

In some alternative implementations of an illustrative example, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram. Some blocks may be optional. For example, any of operation 1108 through operation 1120 of FIG. 11 may be optional.

Figure 12:
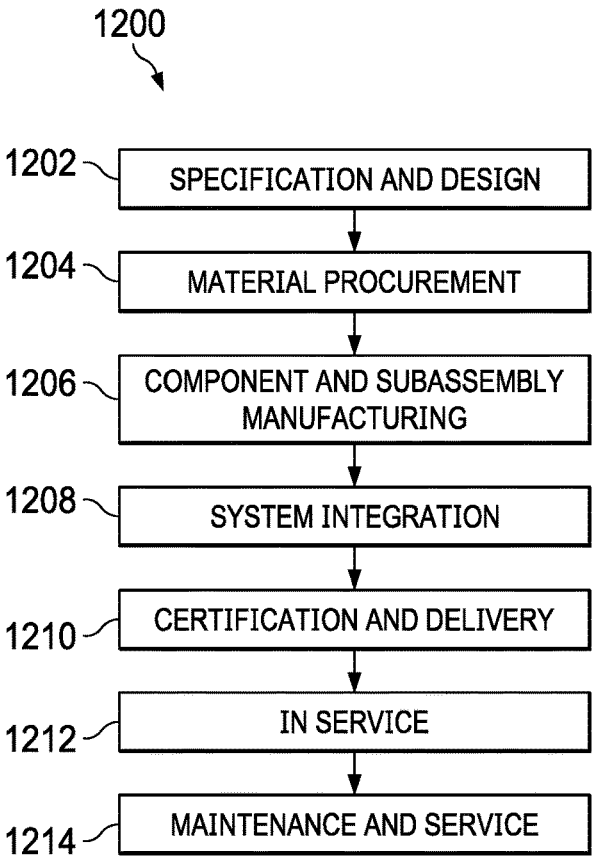
FIG. 12 is an illustration of an aircraft manufacturing and service method in a form of a block diagram in accordance with an illustrative example.
Figure 13:
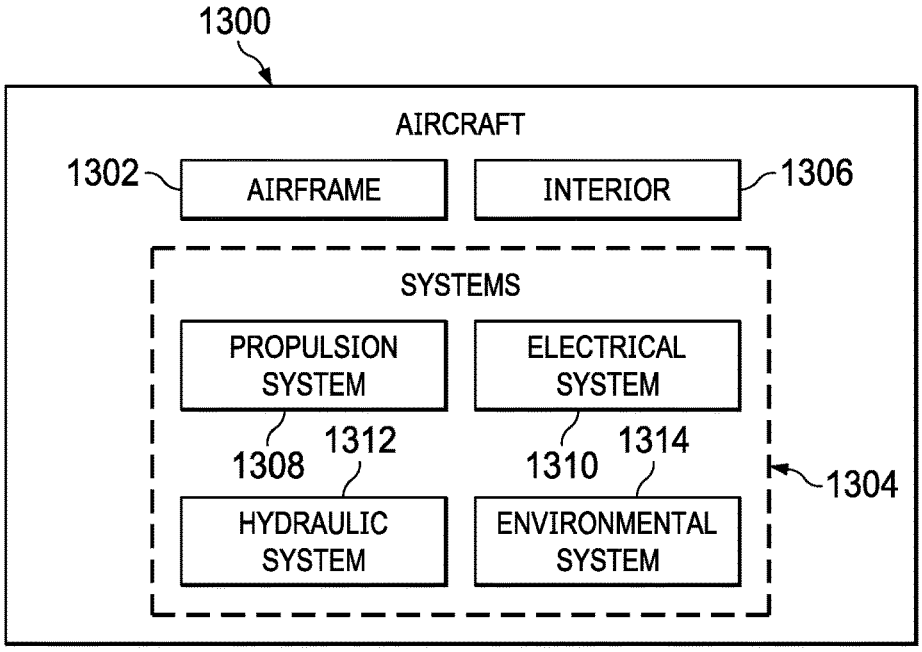
FIG. 13 is an illustration of an aircraft in a form of a block diagram in which an illustrative example may be implemented.

Illustrative examples of the present disclosure may be described in the context of aircraft manufacturing and service method 1200 as shown in FIG. 12 and aircraft 1300 as shown in FIG. 13. Turning first to FIG. 12, an illustration of an aircraft manufacturing and service method is depicted in accordance with an illustrative example. During pre-production, aircraft manufacturing and service method 1200 may include specification and design 1202 of aircraft 1300 in FIG. 13 and material procurement 1204.

During production, component and subassembly manufacturing 1206 and system integration 1208 of aircraft 1300 takes place. Thereafter, aircraft 1300 may go through certification and delivery 1210 in order to be placed in service 1212. While in service 1212 by a customer, aircraft 1300 is scheduled for routine maintenance and service 1214, which may include modification, reconfiguration, refurbishment, or other maintenance and service.

Each of the processes of aircraft manufacturing and service method 1200 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 13, an illustration of an aircraft is depicted in which an illustrative example may be implemented. In this example, aircraft 1300 is produced by aircraft manufacturing and service method 1200 of FIG. 12 and may include airframe 1302 with plurality of systems 1304 and interior 1306. Examples of systems 1304 include one or more of propulsion system 1308, electrical system 1310, hydraulic system 1312, and environmental system 1314. Any number of other systems may be included.

Apparatuses and methods embodied herein may be employed during at least one of the stages of aircraft manufacturing and service method 1200. One or more illustrative examples may be manufactured or used during at least one of component and subassembly manufacturing 1206, or maintenance and service 1214 of FIG. 12. For example, braiding assembly 104 of FIG. 1 or braiding assembly 200 of FIG. 2 can be used to manufacture a braided product during component and subassembly manufacturing 1206 or maintenance and service 1214 of FIG. 12. Braided product 106 of FIG. 1 or braided product 300 of FIG. 3 can be a portion of either airframe 1302 or interior 1306.

The illustrative examples present a penta-axial braiding manufacturing system. The penta-axial braiding manufacturing system comprises a braiding machine consisting of: (a) radial carriers/bobbins (b) front face (circumferential) carriers/bobbins and (c) and axial bobbin holders. The penta-axial braiding manufacturing system further comprises (d) multi-purposed yarn aperture guides and optionally (e) in-line inspection systems. The manufacturing system enables multi-functional braided preforms to be made using up to five materials. The angle at which the fiber yarns intersect can vary for each layer of the braided preform. The illustrative examples enable slender resin infused parts such as spars and frames to be manufactured by automation.

The illustrative examples converts yarns directly into cross-sectional preform for making resin infused slender parts. The illustrative examples are more versatile than existing systems as they allow two additional materials (5 instead of 3) to be incorporated into the preform. The additional two materials can enable multi-functionality to be imparted to the braided product (part).

The illustrative examples present both an arrangement of radial carriers and bobbins around the inner circumference of the braiding machine, and on the same machine, an arrangement of front face carriers and bobbins on the front vertical surface. Axial bobbins are situated on the outer circumference. This braiding machine enables the automatic production of multi-functional complex cross-sectional shaped preforms, and is suitable for making resin infused slender structures such as spars. Up to five materials can be incorporated into the preform. The angles at which the yarns intersect in each layer can vary according to design requirements, allowing the preform to be designed to carry load along desired directions.

In the illustrative examples, independent yarn guiding apertures are presented (instead of braid rings fixed onto the machine). The guide fixture is wheeled into position and locked in place at a desired distance from the braiding machine. The guide assembly of the illustrative examples eliminates the need to mount and dismount braid rings from the braiding machine. Braiding plates of having apertures of different diameters and shapes to suit the part that is braided can be interchanged on the guide assembly.

The yarn guiding apertures are multi-purposed. The guide assemblies are used to guide yarns onto the base to form braids. The guide assembly comprises an array of motors installed on a front surface of the braiding plate to reduce contact time between the yarn and the braiding plate and limit fiber breakages. Frequency and amplitude of the motors can be controlled. In some illustrative examples, the guide assembly further comprises a water sprinkler or vapor sprinkling system to reduce yarn breakage as the yarn slides past the aperture.

A series of systems such as imaging systems or heating and cooling systems can be placed after the guiding assemblies in the feed direction. These additional series of systems can enable defect monitoring or other desired functions.

Clause 1: A penta-axial braiding assembly comprising: a braiding machine comprising: a circular machine bed with an interior curved surface, an exterior curved surface, and a front face; radial bobbins associated with the interior curved surface and configured to dispense a first number of yarns; and front face bobbins associated with the front face and configured to dispense a second number of yarns; a first guide assembly comprising a first braiding plate configured to form a first braiding point for the first number of yarns dispensed from the radial bobbins; and a second guide assembly comprising a second braiding plate configured to form a second braiding point for the second number of yarns dispensed from the front face bobbins.

Clause 2: The penta-axial braiding assembly of clause 1, wherein the braiding machine further comprises axial bobbins associated with the exterior curved surface.

Clause 3: The penta-axial braiding assembly of clauses 1-2, wherein the radial bobbins comprise a first set of bobbins and a second set of bobbins, wherein the first set of bobbins and the second set of bobbins move in opposing serpentine motion to each other, and wherein the front face bobbins comprise a third set of bobbins and a fourth set of bobbins, wherein the third set of bobbins and the fourth set of bobbins move in opposing serpentine motion to each other.

Clause 4: The penta-axial braiding assembly of clauses 1-3, wherein the braiding machine is configured to produce a braided product with the first number of yarns having a first angle and the second number of yarns having a second angle, wherein the first angle is different from the second angle.

Clause 5: The penta-axial braiding assembly of clauses 1-4, wherein the first guide assembly further comprises a frame and a movement system, wherein the first braiding plate is removably connected to the frame, and wherein the movement system is connected to the frame and configured to move the frame towards or away from the braiding machine.

Clause 6: The penta-axial braiding assembly of clause 5, wherein the first guide assembly further comprises a plurality of vibration systems mounted to the first braiding plate.

Clause 7: The penta-axial braiding assembly of clause 6, wherein the plurality of vibration systems is positioned evenly around an aperture of the first braiding plate.

Clause 8: The penta-axial braiding assembly of clause 5, wherein the second guide assembly further comprises a frame and a movement system, wherein the second braiding plate is removably connected to the frame, and wherein the movement system is connected to the frame and configured to move the frame towards or away from the braiding machine.

Clause 9: The penta-axial braiding assembly of clause 8, wherein the second guide assembly further comprises a plurality of vibration systems mounted to the second braiding plate.

Clause 10: The penta-axial braiding assembly of clause 6, wherein the plurality of vibration systems is positioned evenly around an aperture of the second braiding plate.

Clause 11: A braiding machine comprising: a circular machine bed with an interior curved surface, an exterior curved surface, and a front face; radial bobbins associated with the interior curved surface and configured to dispense a first number of yarns; and front face bobbins associated with the front face and configured to dispense a second number of yarns.

Clause 12: The braiding machine of clause 11, wherein the radial bobbins comprise a first set of bobbins and a second set of bobbins, and wherein the first set of bobbins and the second set of bobbins move in opposing serpentine motion to each other.

Clause 13: The braiding machine of clauses 11-12, wherein the front face bobbins comprise a third set of bobbins and a fourth set of bobbins, and wherein the third set of bobbins and the fourth set of bobbins move in opposing serpentine motion to each other.

Clause 14: The braiding machine of clauses 11-13 further comprising: axial bobbins associated with the exterior curved surface.

Clause 15: The braiding machine of clauses 11-14, wherein the radial bobbins are configured to dispense the first number of yarns substantially perpendicular to a dispensed direction of the second number of yarns.

Clause 16: A guide assembly comprising: a frame; a braiding plate removably connected to the frame, the braiding plate having an aperture; and a movement system connected to the frame and configured to move the frame across a manufacturing floor.

Clause 17: The guide assembly of clause 16, further comprising: a plurality of vibration systems mounted to the braiding plate.

Clause 18: The guide assembly of clause 17, wherein the plurality of vibration systems is positioned evenly around the aperture of the braiding plate.

Clause 19: The guide assembly of clauses 16-18, wherein the movement system comprises wheels.

Clause 20: The guide assembly of clauses 16-19 further comprising: a water dispensing system mounted to a first face of the braiding plate and configured to dispense water onto a plurality of yarns prior to extending through the aperture.

Clause 21: The guide assembly of clauses 16-20 further comprising: a nozzle mounted to the braiding plate, the nozzle configured to dispense air.

Clause 22: The guide assembly of clauses 16-21, wherein a shape of the aperture is configured based on a cross-sectional shape of a braided product to be produced.

Clause 23: A method comprising: sending a base through a braiding machine, a first guide assembly, and a second guide assembly, the braiding machine comprising a circular machine bed with an interior curved surface, an exterior curved surface, and a front face, radial bobbins associated with the interior curved surface and configured to dispense a first number of yarns, and front face bobbins associated with the front face and configured to dispense a second number of yarns; braiding the first number of yarns onto the base at a first braiding point created by a first braiding plate of the first guide assembly; and braiding the second number of yarns over the first number of yarns at a second braiding point created by a second braiding plate of the second guide assembly.

Clause 24: The method of clause 23 wherein braiding the first number of yarns onto the base comprises braiding the first number of yarns at a first angle, wherein braiding the second number of yarns over the first number of yarns comprises braiding the second number of yarns at a second angle, and wherein the first angle is different from the second angle.

Clause 25: The method of clauses 23-24 further comprising: sending axial yarns parallel to the base, wherein braiding the first number of yarns onto the base comprises tri-axial braiding with the first number of yarns and the axial yarns.

Clause 26: The method of clauses 23-25 further comprising: vibrating the first braiding plate with a controlled frequency and amplitude using a plurality of vibration systems mounted around an aperture of the first braiding plate.

Clause 27: The method of clauses 23-26 further comprising: vibrating the second braiding plate with a controlled frequency and amplitude using a plurality of vibration systems mounted around an aperture of the second braiding plate.

Clause 28: The method of clause 27, wherein the controlled frequency and amplitude of vibration of the first braiding plate is different from the controlled frequency and amplitude of vibration of the second braiding plate.

Clause 29: The method of clauses 23-28 further comprising: wetting the first number of yarns prior to exiting the first braiding plate.

Clause 30: The method of clauses 23-29 further comprising: wetting the second number of yarns prior to exiting the second braiding plate.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A penta-axial braiding assembly comprising:

a braiding machine comprising:

a circular machine bed with an interior curved surface, an exterior curved surface, and a front face;

radial bobbins associated with the interior curved surface and configured to dispense a first number of yarns; and front face bobbins associated with the front face and configured to dispense a second number of yarns;

a first guide assembly comprising a first braiding plate configured to form a first braiding point for the first number of yarns dispensed from the radial bobbins; and a second guide assembly comprising a second braiding plate configured to form a second braiding point for the second number of yarns dispensed from the front face bobbins.

2. The penta-axial braiding assembly of claim 1, wherein the braiding machine further comprises axial bobbins associated with the exterior curved surface.

3. The penta-axial braiding assembly of claim 1, wherein the radial bobbins comprise a first set of bobbins and a second set of bobbins, wherein the first set of bobbins and the second set of bobbins move in opposing serpentine motion to each other, and wherein the front face bobbins comprise a third set of bobbins and a fourth set of bobbins, wherein the third set of bobbins and the fourth set of bobbins move in opposing serpentine motion to each other.

4. The penta-axial braiding assembly of claim 1, wherein the braiding machine is configured to produce a braided product with the first number of yarns having a first angle and the second number of yarns having a second angle, wherein the first angle is different from the second angle.

5. The penta-axial braiding assembly of claim 1, wherein the first guide assembly further comprises a frame and a movement system, wherein the first braiding plate is removably connected to the frame, and wherein the movement system is connected to the frame and configured to move the frame towards or away from the braiding machine.

6. The penta-axial braiding assembly of claim 5, wherein the first guide assembly further comprises a plurality of vibration systems mounted to the first braiding plate.

7. The penta-axial braiding assembly of claim 6, wherein the plurality of vibration systems is positioned evenly around an aperture of the first braiding plate.

8. The penta-axial braiding assembly of claim 5, wherein the second guide assembly further comprises a frame and a movement system, wherein the second braiding plate is removably connected to the frame, and wherein the movement system is connected to the frame and configured to move the frame towards or away from the braiding machine.

9. The penta-axial braiding assembly of claim 8, wherein the second guide assembly further comprises a plurality of vibration systems mounted to the second braiding plate.

10. The penta-axial braiding assembly of claim 9, wherein the plurality of vibration systems is positioned evenly around an aperture of the second braiding plate.

11. A braiding machine comprising:

a circular machine bed with an interior curved surface, an exterior curved surface, and a front face;

radial bobbins associated with the interior curved surface and configured to dispense a first number of yarns; and front face bobbins associated with the front face and configured to dispense a second number of yarns, wherein the radial bobbins comprise a first set of bobbins and a second set of bobbins, and wherein the first set of bobbins and the second set of bobbins move in opposing serpentine motion to each other.

12. The braiding machine of claim 11, wherein the front face bobbins comprise a third set of bobbins and a fourth set of bobbins, and wherein the third set of bobbins and the fourth set of bobbins move in opposing serpentine motion to each other.

13. The braiding machine of claim 11, wherein the radial bobbins are configured to dispense the first number of yarns substantially perpendicular to a dispensed direction of the second number of yarns.

14. A braiding machine comprising:

a circular machine bed with an interior curved surface, an exterior curved surface, and a front face;

radial bobbins associated with the interior curved surface and configured to dispense a first number of yarns;

front face bobbins associated with the front face and configured to dispense a second number of yarns; and axial bobbins associated with the exterior curved surface.

15. A guide assembly comprising:

a frame;

a braiding plate removably connected to the frame, the braiding plate having an aperture;

a movement system connected to the frame and configured to move the frame across a manufacturing floor; and a plurality of vibration systems mounted to the braiding plate.

16. The guide assembly of claim 15, wherein the plurality of vibration systems is positioned evenly around the aperture of the braiding plate.

17. The guide assembly of claim 15, wherein the movement system comprises wheels.

18. The guide assembly of claim 15, wherein a shape of the aperture is configured based on a cross-sectional shape of a braided product to be produced.

19. A guide assembly comprising:

a frame;

a braiding plate removably connected to the frame, the braiding plate having an aperture;

a movement system connected to the frame and configured to move the frame across a manufacturing floor; and a water dispensing system mounted to a first face of the braiding plate and configured to dispense water onto a plurality of yarns prior to extending through the aperture.

20. A guide assembly comprising:

a frame;

a braiding plate removably connected to the frame, the braiding plate having an aperture;

a movement system connected to the frame and configured to move the frame across a manufacturing floor; and a nozzle mounted to the braiding plate, the nozzle configured to dispense air.

21. A method comprising:

sending a base through a braiding machine, a first guide assembly, and a second guide assembly, the braiding machine comprising a circular machine bed with an interior curved surface, an exterior curved surface, and a front face, radial bobbins associated with the interior curved surface and configured to dispense a first number of yarns, and front face bobbins associated with the front face and configured to dispense a second number of yarns;

braiding the first number of yarns onto the base at a first braiding point created by a first braiding plate of the first guide assembly; and braiding the second number of yarns over the first number of yarns at a second braiding point created by a second braiding plate of the second guide assembly.

22. The method of claim 21 wherein braiding the first number of yarns onto the base comprises braiding the first number of yarns at a first angle, wherein braiding the second number of yarns over the first number of yarns comprises braiding the second number of yarns at a second angle, and wherein the first angle is different from the second angle.

23. The method of claim 21 further comprising:

sending axial yarns parallel to the base, wherein braiding the first number of yarns onto the base comprises tri-axial braiding with the first number of yarns and the axial yarns.

24. The method of claim 21 further comprising:

vibrating the first braiding plate with a controlled frequency and amplitude using a plurality of vibration systems mounted around an aperture of the first braiding plate.

25. The method of claim 22 further comprising:

vibrating the second braiding plate with a controlled frequency and amplitude using a plurality of vibration systems mounted around an aperture of the second braiding plate.

26. The method of claim 25, wherein the controlled frequency and amplitude of vibration of the first braiding plate is different from the controlled frequency and amplitude of vibration of the second braiding plate.

27. The method of claim 21 further comprising:

wetting the first number of yarns prior to exiting the first braiding plate.

28. The method of claim 27 further comprising:

wetting the second number of yarns prior to exiting the second braiding plate.

* * * * *